US006384379B1

(12) United States Patent
Reime

(10) Patent No.: US 6,384,379 B1
(45) Date of Patent: May 7, 2002

(54) PROTECTIVE DEVICE FOR AN IRON AND IRON INCORPORATING SAME

(76) Inventor: Gerd Reime, Friedenstrasse 88, Schömberg D-75328 (DE)

( * ) Notice: Subject to any disclaimer, the term of this patent is extended or adjusted under 35 U.S.C. 154(b) by 0 days.

(21) Appl. No.: 09/763,830

(22) PCT Filed: Aug. 3, 1999

(86) PCT No.: PCT/EP99/05618

§ 371 Date: Feb. 27, 2001

§ 102(e) Date: Feb. 27, 2001

(87) PCT Pub. No.: WO00/12806

PCT Pub. Date: Mar. 9, 2000

(30) Foreign Application Priority Data

Jan. 9, 1998 (DE) ..... 198 39 730

(51) Int. Cl.[7] ..... D06F 75/26
(52) U.S. Cl. ..... 219/257; 38/82
(58) Field of Search ..... 219/257, 250, 219/248, 518; 38/82, 74

(56) References Cited

U.S. PATENT DOCUMENTS

| | | | | |
|---|---|---|---|---|
| 4,130,955 A | * | 12/1978 | Baumgartner et al. | 38/82 |
| 4,661,685 A | * | 4/1987 | Contri | 219/250 |
| 4,686,352 A | * | 8/1987 | Nawrot et al. | 219/257 |
| 4,727,240 A | * | 2/1988 | Provolo et al. | 219/250 |
| 4,745,260 A | * | 5/1988 | Albinger, Jr. et al. | 219/250 |
| 5,345,060 A | * | 9/1994 | Hazan et al. | 219/250 |
| 5,391,859 A | * | 2/1995 | Hazan et al. | 219/250 |
| 5,721,418 A | | 2/1998 | Hazan et al. | |
| 5,818,011 A | * | 10/1998 | Ito et al. | 219/257 |

FOREIGN PATENT DOCUMENTS

| | | | |
|---|---|---|---|
| DE | G 89 08132 | | 10/1989 |
| DE | 692 06 207 | | 6/1996 |
| EP | 459 559 | A1 | 12/1991 |
| EP | 523793 | A1 | 1/1993 |
| EP | 612996 | A2 | 8/1994 |
| GB | 2197515 | * | 5/1988 |
| JP | 61-154700 | * | 7/1986 |
| JP | 61-265199 | * | 11/1986 |
| JP | 63-206298 | * | 8/1988 |
| JP | 4-114699 | A2 | 4/1992 |
| JP | 7-299299 | * | 11/1995 |
| WO | 8203520 | * | 10/1982 |
| WO | WO9501561 | A1 | 1/1995 |
| WO | WO9634510 | A2 | 10/1996 |

* cited by examiner

*Primary Examiner*—John A. Jeffery
(74) *Attorney, Agent, or Firm*—Kenyon & Kenyon

(57) ABSTRACT

A protective device for an iron having an iron surface and a thermostatically controlled heating device for heating the iron surface. The protective device comprises: a first device for detecting a non-operative state of the iron by being configured to detect a movement and a lack of movement of the iron surface and an object relative to one another thereby generating a first signal; a second device for detecting whether an object is located adjacent the iron surface thereby generating a second signal, wherein the first device and the second device operate in a temporally offset manner and comprise a single system including a transmitter and a receiver for generating the first signal and the second signal; and a logic unit operatively coupled to the single system for receiving the first signal and the second signal therefrom and for interrupting a current supply to the heating device as a function of the first signal and of the second signal when, simultaneously, the first signal indicates a lack of movement of the iron and the second signal indicates an object adjacent the iron surface.

10 Claims, 4 Drawing Sheets

PROTECTIVE DEVICE FOR AN IRON AND IRON INCORPORATING SAME

FIELD OF THE INVENTION

The invention relates to a protective device for an iron.

BACKGROUND OF THE INVENTION

Irons are usually used for ironing clothing. Problems appear regularly with the use of irons as soon as the risk of overheating arises. This overheating can occur on the one hand as soon as the iron standing on the iron surface is forgotten about by the user or, as a result of carelessness, when an object such as an item about to be ironed is thrown over the iron surface or falls thereon by chance.

A protective device for irons is disclosed in JP 4-114699 A in which a contact switch is provided on the base of the iron. The switch maintains the current supply if the iron is placed on its end. If the iron is guided over an object by its iron surfaced, a further light-sensitive sensor establishes that the iron is abutting against a surface to be ironed and in principle interrupts the current supply to the heating surface. As a further condition, which is required to maintain the current supply to the heating surface when the light-sensitive sensor is applied to a surface, a device is provided in the handle in order to allow a tracking current upon actuation of the handle by the user. If the logic unit then establishes that a tracking current is flowing and, in parallel, that the light-sensitive sensor is abutting against a surface, further heating of the heating surface is permitted. Therefore, it is not established in JP4-114699 whether the iron is moving or not. Instead, it is merely established within the iron is being actuated by a person. A further problem in JP4-114699 resides in the fact that, when the iron is placed on its end, the heating surface is constantly heated with the result that it would not be possible to ensure that in fact burning would not result if an item of clothing should fall in front of the iron by chance while the user has to answer for example the telephone.

A contact switch is disclosed in DE-G 89 08 132.3 which contains a rolling element that responds to gravity and maintains the current supply as long as the iron is moved in a horizontal position in its position of use. If the iron is placed on its end for example in order to set it aside while the washing is being folded, the contact element rolls into a sustained contact position. However, an undesirable side-effect thereof is that, when sitting on its end, an object can get too close to the heating surface as no check is made of whether an object is situated in front of the heating surface.

In DE 692 06 207 T2 and in the associated European Patent 0 523 793 B1, there is disclosed a textile type sensor which is intended to make possible automatic adjustment of the iron to different types of textiles. In a preferred embodiment, there is provided through a heatable substrate a measuring arrangement for detecting the reflection behavior of the textiles located under the substrate. This measuring arrangement is commonly used and comprises a light emitting diode and a light-sensitive phototransistor. There is no provision for the measured length to be configured with a light diode also as a receiver although this has significant advantages with regard to cost.

SUMMARY OF THE INVENTION

Proceeding from the state of the art, the basic object of the invention is to develop an iron in such a manner that an effective, easy-to-integrate protection is produced that ascertains at any time whether there is a risk of overheating of objects abutting against the iron surface and which thereupon switches off the iron.

The invention provides a protective device for an iron having an iron surface and a thermostatically controlled heating device for heating the iron surface. The protective device comprises: a first device for detecting a non-operative state of the iron by being configured to detect a movement and a lack of movement of the iron surface and an object relative to one another thereby generating a first signal; a second device for detecting whether an object is located adjacent the iron surface thereby generating a second signal, wherein the first device and the second device operate in a temporally offset manner and comprise a single system including a transmitter and a receiver for generating the first signal and the second signal; and a logic unit operatively coupled to the single system for receiving the first signal and the second signal therefrom and for interrupting a current supply to the heating device as a function of the first signal and of the second signal when, simultaneously, the first signal indicates a lack of movement of the iron and the second signal indicates an object adjacent the iron surface.

The invention further provides an iron comprising an iron surface; a thermostatically controlled heating device for heating the iron surface; and a protective device. The protective device includes: a first device for detecting a non-operative state of the iron by being configured to detect a movement and a lack of movement of the iron surface and an object relative to one another thereby generating a first signal; a second device for detecting whether an object is located adjacent the iron surface thereby generating a second signal, wherein the first device and the second device operate in a temporally offset manner and comprise a single system including a transmitter and a receiver for generating the first signal and the second signal; and a logic unit operatively coupled to the single system for receiving the first signal and the second signal therefrom and for interrupting a current supply to the heating device as a function of the first signal and of the second signal when, simultaneously, the first signal indicates a lack of movement of the iron and the second signal indicates an object adjacent the iron surface.

The protective device registers the position of the iron and also whether an object is actually situated in front of the iron surface. Two conditions are thereby regularly queried via a logic unit, namely:

a) whether or not the iron is still moving, and
b) whether or not an object is located in front of the iron surface.

According to the present invention, only when the iron is not moving and, simultaneously an object is located near the iron surface, is the current supply interrupted so that damage or even burning cannot result. In all other cases in which it is undesirable for the iron to switch off automatically, the current supply is maintained.

Additionally, according to the present invention, detection of movement and of the object by detectors results via the same transmitters and receivers and via the same measured lengths. The transmitters beam the light which is reflected from the surfaces to be ironed or from an object located above the iron surface. If it is thereby established that the reflection does not change over a specific period of time, both the presence of the object and the lack of movement are established which leads to interruption of the current supply for the heating device.

BRIEF DESCRIPTION OF THE DRAWINGS

The foregoing objects of the invention, together with other objects and advantages which may be attained by its use, will become more apparent upon reading the following detailed description of the invention, taken in conjunction with the drawings. In the drawings, where like numerals refer to corresponding components.

DETAILED DESCRIPTION OF THE INVENTION

Figure 1:
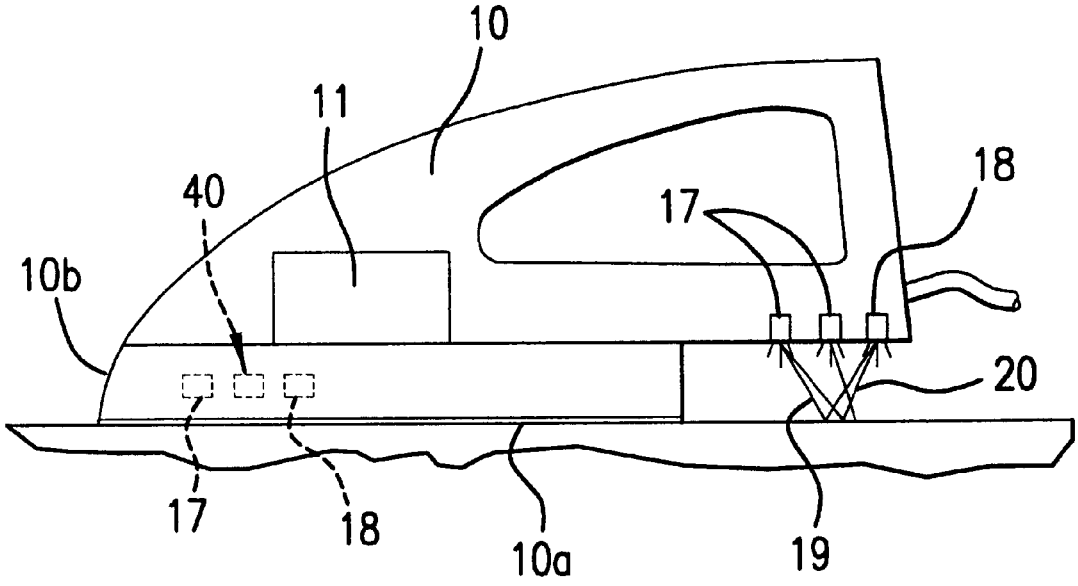
FIG. 1 is a schematic, side-elevation view of an iron according a preferred embodiment the invention.

FIG. 1 illustrates an ironing implement on iron 10 having a protective device for protection against overheating of the iron or burning objects placed in contact with the iron surface 10*a* because of carelessness or by chance. The shown ironing implement 10, normally a pressing iron, has a thermostatically controlled heating device 11 for heating the iron surface 10*a*. A first device 13 is integrated in the iron (not shown in FIG. 1) for detecting the non-operative state of the iron, in particular, a movement and a lack of movement of the iron and an object relative to one another, such as the movement of the iron 10, the circuit diagram of this device being illustrated in the upper part of FIG. 2. Dependent upon the detected position of the iron 10, a logic unit interrupts the current supply to the heating device 11 thus affecting the heat control 15 in FIG. 5, as will be described in further detail below.

Figure 2:
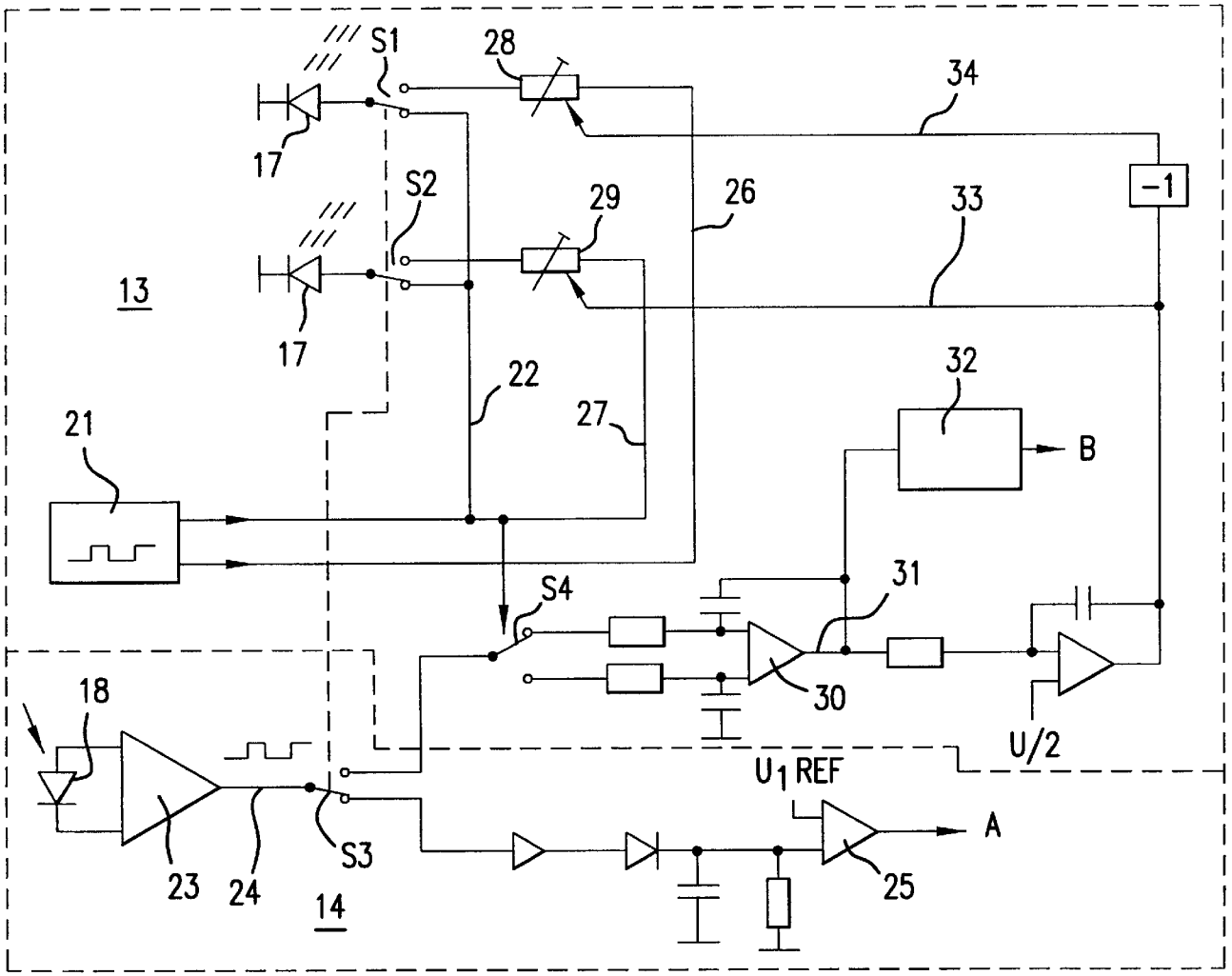
FIG. 2 a schematic circuit diagram of preferred embodiments of the device for detecting the object and of the detection device.

The device 13 for detecting the non-operative state of the iron 11 can detect the movement of the iron 10 by means of the circuit diagram shown in FIG. 2. At the same time in the lower part of FIG. 2, there is provided a second device or detection device 14 in order to detect whether or not an object is located against or adjacent the iron surface 10*a*. Depending on a first signal or the signal B, which is generated by device 13 and which indicate s a detection of a non-operative state and the movement or lack of movement of the iron 10, depending further and on second signal, or signal A which is generated by device 14 and which indicates a detection of the object by the detection device 14, the current supply to the heating device 11 is interrupted. This interruption takes place when both of the following occur the device 13 for detecting the non-operative state of the iron 10 establishes that the iron 10 is not moving, and, in addition, the detection device 14 establishes that an object is present against the iron surface 10*a*.

Figure 5:
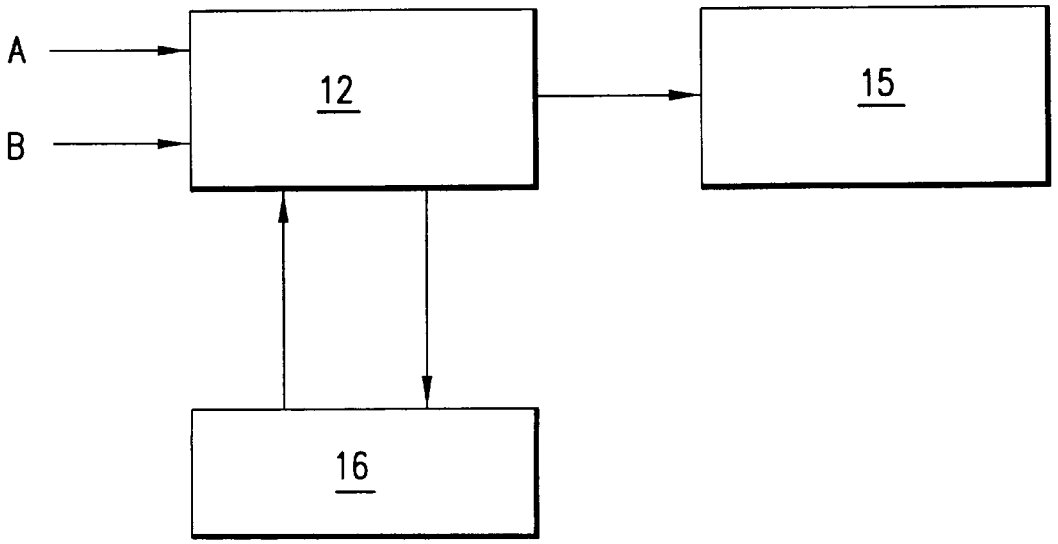
FIG. 5 is a schematic representation of the logic unit to be used in conjunction with the circuit diagram of FIG. 2

The logic unit 12 shown in FIG. 5 thus maintains the current supply to the iron surface 10*a* if no object is abutting against the iron surface 10*a*, or if something is abutting against the iron surface 10*a* but the iron surface is indeed still moving relative to the object. In this respect, the interruption of the current supply to the iron can be effected temporally, here with a specific time delay according to a preferred embodiment of the invention.

Figure 6:
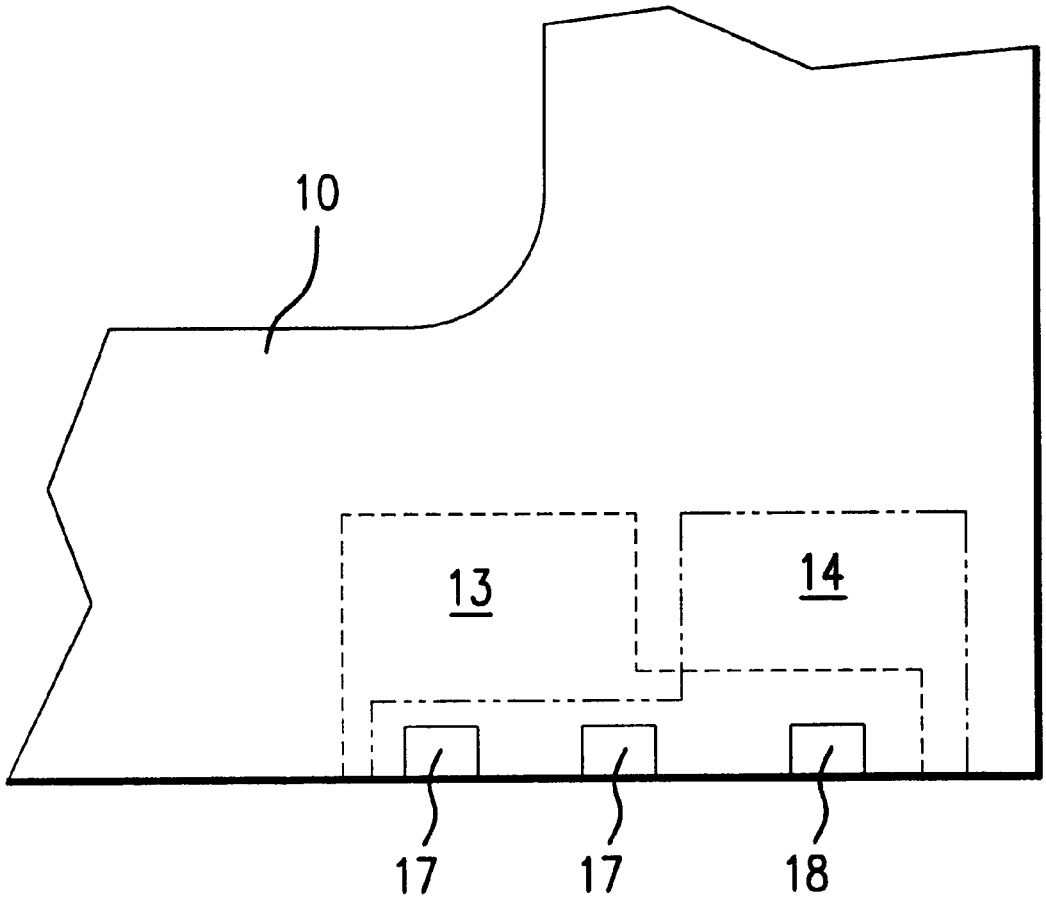
FIG. 6 is a schematic representation showing a detail of FIG. 1 corresponding to a location of the transmitters and receiver according to an embodiment of the invention.

Both device 13 for detecting the non-operative state of the iron 10 and detection device 14 are optoelectronic measuring devices, and include a transmitter 17 and a receiver 18. In principle, according to a preferred embodiment, a generation of both signal A and signal B are effected via the same transmitter 17 and receiver 18, so that these are operated in a temporally offset manner, once according to the top illustration in FIG. 2, and once according to the bottom illustration in FIG. 2. Devices 13 and 14 are shown in broken lines in FIG. 6 to suggest that they are operated in the temporally offset manner mentioned above. As shown in FIG. 6, devices 13 and 14 may both incorporate transmitters 17 and receiver 18, and each incorporate additional components described in further detail below with respect to FIG. 2. The impulse generator 21 of FIG. 2 produces the signal to be processed by device 13 over a specific period of time, for example for 50 cycles, and then it produces the signal to be processed by detection device 14 subsequently for 50 cycles. According to the preferred embodiment of the invention shown in FIG. 1, a plurality of transmitters 17 and at least one receiver 18 are provided for this purpose in order to form at least two measured lengths 19 and 20 as required. The concrete embodiment of devices 13 and 14 includes three light diodes, two of which are operated as transmitters 17 and one as receiver 18.

In order to be able to use at least the two transmitters 17 with receiver 18 in connection with the two measured lengths 19 and 20 as the device 13 for detecting the non-operate state of the iron 10 during detection of movement, the two transmitters 17 are pulsed reciprocally, whilst they are pulsed simultaneously as detection device 14.

The above is explained in more detail below with respect to FIG. 2.

Figure 4:
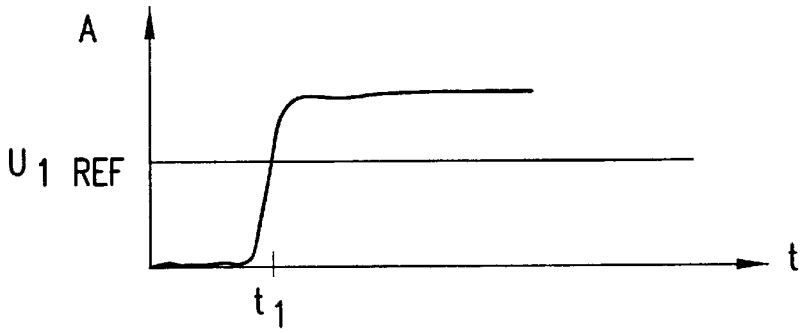
FIG. 4 is a graph plotting the course over time of the signal A from FIG. 2 when an object is placed against the iron surface.

First, the detection of the object by detection device 14 takes place in the position of the switches S1, S2, S3 according to FIG. 2. Line 22, ensures that both light diodes 17 are subjected to the same signal and hence clocked simultaneously to the cycle frequency of the impulse generator 21. The radiation of the transmitters 17 is detected by the light diode as receiver 18 and amplified as an electrical signal in an operational amplifier 23. A signal corresponding to the cycle of the impulse amplifier 21 on the line 24 hence is on the signal line at the output of the operational amplifier 23 upon occurrence of a reflection, i.e. when an object is near the iron surface 10*a*. The signal is then fed to a comparator 25 via the switch S3. The, comparator 25 has a reference voltage $U_{1,REF}$ as an equivalent value and as shown in the graph of FIG. 4 so that a signal A is produced as soon as the reference voltage is exceeded. After the time t1 in FIG. 4, the detection device 14 therefore establishes the presence of an object. The detection of an object is performed over a specific number of cycles, for example over 50 cycles of the frequency of the impulse generator 21, i.e. a few milliseconds up to a few seconds.

Figure 3:
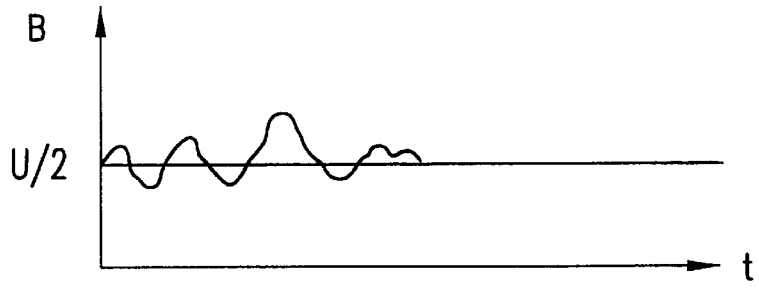
FIG. 3 is a graph plotting the course over time of signal B from FIG. 2 upon occurrence of a movement of the iron.

Thereafter a switch-over to the device 13 for detecting the non-operative state or movement of the iron 10 occur, the switches S1, S2 and S3 being shifted into their corresponding opposite positions. Such a device is known from WO-A 95/01561, although it is used there to detect the wetting of surfaces. However the above principle operates according to the present invention in a similar manner. As seen in the upper part of FIG. 2 in relation to device 13, it is clear that the upper transmitter 17 is actuated via line 26 with an inverted signal from impulse generator 21, whilst the lower transmitter 17 continues to be actuated via line 27 via the output signal of impulse generator 21. Adjustable resistors 28 and 29 are provided in respective lines 26 and 27 this switching arrangement in connection with the associated control of adjustable resistors 28 and 29 being known from WO-A 95/01561. However in the shown preferred in embodiment the frequency sequence of the impulse generator 21, a light signal is at first transmitted alternately from the transmitters 17 to the receiver 18. This signal is transmitted at the switch S4 with the same cycle frequency via two signal lines and fed to a comparator 30 which determines a differential value from the two values obtained in a temporally offset manner, the differential value being transmitted via line 31. This signal is passed on to a window discriminator 32 which determines signal B from comparator 30. If the iron is moved, signals are produced by device 13 as seen in the graph according to FIG. 3. However if the iron is not moved, then, only the reference value U/2 is present as the signal from discriminator 32. In that case the output signal is redirected to the adjustable resistors 29 and 28, once via the line 33 and once inverted via the line 34 in order to readjust the adjustable resistors 28 and 29 so that the pending signals can be directed to zero at a time constant when the iron 10 is not being in order to free the measured lengths for detecting new signals. As a result, dynamic changes in movement can be reliably detected. The detection of movement is facilitated in that the surface, which the iron 10 normally irons, is not an absolutely homogeneous surface. However, because of the measuring arrangement, according to the present invention a sensitive measurement is possible even on a white cloth.

According to FIG. 5, signals A and B are fed to logic unit 12 which waits initially for a period of time by means of a timer 16 in case both conditions occur for a current interruption, namely in the event that the iron or ironing implement 10 is no longer moving and that at the same time an object abuts against the iron surface 10*a*. However, if nothing else changes during the running of the timer, then the heating control 15 is instructed to interrupt the current supply to the heating device 11.

The operation of the protective device can be improved according to a preferred embodiment of the invention by providing at least one further detection device 40 for detecting an object in the front region of the iron 10, preferably at the tip 10*b* or in the iron surface 10*a*. When the iron 10 is switched on and sitting on its end, the hottest and hence most dangerous regions are located precisely where the most readily inflammable parts or items of clothing can fall such as, for example, at the tip 10*b*. The detection device 40 can be disposed on or looking through the iron surface 10*a*; however, it is also possible for an arrangement to be oriented upwardly on the tip 10*b*. In order to evaluate the signals, the detection device 40 is preferably connected in parallel to the detection device 14.

The invention now having been fully described, it will be apparent that any changes and modifications can be made thereto without departing from the spirit or scope of the invention as set forth in the appended claims.

What is claimed is:

1. A protective device for an iron having an iron surface and a thermostatically controlled heating device for heating the iron surface, the protective device comprising:

a first device for detecting a non-operative state of the iron by being configured to detect a movement and a lack of movement of the iron surface and an object relative to one another thereby generating a first signal;

a second device for detecting whether an object is located adjacent the iron surface thereby generating a second signal, wherein the first device and the second device operate in a temporally offset manner and comprise a single system including a transmitter and a receiver for generating the first signal and the second signal; and a logic unit operatively coupled to the single system for receiving the first signal and the second signal therefrom and for interrupting a current supply to the heating device as a function of the first signal and of the second signal when, simultaneously, the first signal indicates a lack of movement of the iron and the second signal indicates an object adjacent the iron surface.

2. The protective device according to claim 1, wherein the logic unit is configured for maintaining the current supply to the iron surface if the first signal indicates a movement of an object relative to the iron surface or if the second signal indicates an absence of an object adjacent the iron surface.

3. The protective device according to claim 1, wherein the first device and the second device comprise optoelectronic measuring devices including a transmitter and a receiver.

4. The protective device according to claim 1, wherein the transmitter and the receiver comprise a plurality of transmitters and at least one receiver for forming at least two measured lengths.

5. The protective device according to claim 4, wherein the single system is configured to pulse the plurality of transmitters reciprocally during an operation of the first device and to pulse the plurality of transmitters simultaneously during an operation of the second device.

6. The protective device according to claim 1, wherein the transmitter and the receiver are light diodes.

7. An iron comprising:

an iron surface;

a thermostatically controlled heating device for heating the iron surface; and a protective device including:

a first device for detecting a non-operative state of the iron by being configured to detect a movement and a lack of movement of the iron surface and an object relative to one another thereby generating a first signal;

a second device for detecting whether an object is located adjacent the iron surface thereby generating a second signal, wherein the first device and the second device operate in a temporally offset manner and comprise a single system including a transmitter and a receiver for generating the first signal and the second signal; and a logic unit operatively coupled to the single system for receiving the first signal and the second signal therefrom and for interrupting a current supply to the heating device as a function of the first signal and of the second signal when, simultaneously, the first signal indicates a lack of movement of the iron and the second signal indicates an object adjacent the iron surface.

8. The iron according to claim 7, wherein:

the iron has a back region; and the single system is disposed at the back region of the iron.

9. The iron according to claim 8, further comprising a third device for detecting whether an object is located adjacent the iron surface thereby generating a third signal, the third device including a transmitter and a receiver for generating the third signal, wherein the logic unit is operatively connected to the third device for receiving the third signal therefrom and for interrupting the current supply to the heating device as a function of the first signal, the second signal and the third signal when, simultaneously, the first signal indicates a lack of movement of the iron and at least one of the second signal and the third signal indicates an object adjacent the iron surface.

10. The iron according to claim 9, further including a tip region, the second device being located at the back region of the iron and the third device being located at the tip region of the iron.

* * * * *

UNITED STATES PATENT AND TRADEMARK OFFICE

CERTIFICATE OF CORRECTION

PATENT NO. : 6,384,379 B1
DATED : May 7, 2002
INVENTOR(S) : Gerd Reime

It is certified that error appears in the above-identified patent and that said Letters Patent is hereby corrected as shown below:

Column 1,
Line 35, change “within” to -- whether --.

Column 2,
Line 60, after “simultaneously” insert -- , --.

Column 3,
Line 39, change “on” to -- or --.
Line 41, after “burning” insert -- of --.
Line 64, after “or” delete “the”.
Line 65, change “indicate s” to -- indicates --.

Column 4,
Line 16, after “temporally” delete “,”.

Column 5,
Line 13, change “occur” to -- occurs --.
Line 24, after “27” insert -- , --.
Lines 27-28, change “in embodiment” to -- embodiment in --.
Line 41, after “case” insert -- , --.

Signed and Sealed this

Seventeenth Day of June, 2003

JAMES E. ROGAN
*Director of the United States Patent and Trademark Office*